US009179787B2

(12) United States Patent
Jacobs

(10) Patent No.: US 9,179,787 B2
(45) Date of Patent: Nov. 10, 2015

(54) METHOD AND DEVICE FOR CARRYING YOUNG HUMANS

(71) Applicant: Eliana Jacobs, Titusville, FL (US)

(72) Inventor: Eliana Jacobs, Titusville, FL (US)

(73) Assignee: Little Joey LLC, Titusville, FL (US)

( * ) Notice: Subject to any disclaimer, the term of this patent is extended or adjusted under 35 U.S.C. 154(b) by 273 days.

(21) Appl. No.: 13/890,658

(22) Filed: May 9, 2013

(65) Prior Publication Data

US 2013/0299532 A1 Nov. 14, 2013

Related U.S. Application Data

(60) Provisional application No. 61/645,018, filed on May 9, 2012.

(51) Int. Cl.
*A47D 13/02* (2006.01)

(52) U.S. Cl.
CPC ..... *A47D 13/02* (2013.01)

(58) Field of Classification Search
CPC ..... A47D 13/02
USPC ..... 224/158–161
See application file for complete search history.

(56) References Cited

U.S. PATENT DOCUMENTS

| | | | | |
|---|---|---|---|---|
| 5,950,887 | A * | 9/1999 | Powell | 224/158 |
| 6,065,655 | A * | 5/2000 | Parewick | 224/158 |
| 6,098,857 | A | 8/2000 | Le Gal | |
| 6,595,396 | B2 | 7/2003 | Cummings | |
| D509,056 | S | 9/2005 | Shiraishi et al. | |
| 6,988,644 | B1 * | 1/2006 | Asherbranner | 224/160 |
| 8,973,793 | B2 * | 3/2015 | Arvan | 224/159 |
| 2002/0175194 | A1 * | 11/2002 | Norman | 224/160 |
| 2006/0237493 | A1 * | 10/2006 | Tsai | 224/159 |
| 2007/0278264 | A1 * | 12/2007 | Chesal et al. | 224/160 |
| 2012/0248159 | A1 * | 10/2012 | Rahni | 224/158 |
| 2012/0286002 | A1 * | 11/2012 | Dardel et al. | 224/159 |

* cited by examiner

*Primary Examiner* — Brian D Nash
*Assistant Examiner* — Corey Skurdal
(74) *Attorney, Agent, or Firm* — Kelly G. Swartz; Widerman Malek, P.L.

(57) ABSTRACT

A wrap for carrying a young human comprising two rectangular pieces of fabric and a fastening device comprising a plurality of apertures, wherein the first end of the first piece of fabric is secured to the portion of the fastening device disposed between the inner aperture and the first middle aperture, and wherein the third end or the second piece of fabric is secured to the portion of the fastening device disposed between the inner aperture and the third middle aperture.

17 Claims, 4 Drawing Sheets

METHOD AND DEVICE FOR CARRYING YOUNG HUMANS

RELATED APPLICATIONS

This application is related to and claims the benefit of U.S. Provisional Patent Application Ser. No. 61/645,018 titled Craft E Wrap Baby Carrier filed on May 9, 2013, the entire contents of which are incorporated herein by reference.

FIELD OF THE INVENTION

The present invention relates to the field of wearable baby carriers. More specifically, the present invention relates to baby carriers that include fabric that is wrapped around the carrier's body.

BACKGROUND OF THE INVENTION

Various types of wearable baby carriers that are configured to enable a person to wear the carriers comfortably and safely carry a baby therein are known. Among the various types of wearable baby carriers are front and back carriers comprising a sear or "pouch" for holding the baby on the chest or back of a person wearing the carrier, and an arrangement of straps and/or belts attached to the pouch for securing the pouch to the wearer. Typically the straps and/or belts comprise shoulder straps that are looped over the wearer's shoulder and a belt strap that is buckled around the wearer's waist. U.S. Pat. No. 6,098,857 describes a backpack type baby carrier. U.S. Pat. No. D509,056 shows a frontpack baby carrier.

Sling baby carriers usually comprise a "bandolier" sling of material that is slung over a shoulder to form a "hammock" into which a baby may be placed to be held on the wearer's chest. U.S. Pat. No. 5,950,887 describes a sling baby carrier having a set of rings through which an end of the sling is looped so that its length is adjustable. U.S. Pat. No. 6,595,396 describes a sling baby carrier formed with a seat region and a cord for securing a baby in the seat.

SUMMARY OF THE INVENTION

With the foregoing in mind, embodiments of the present invention are related to wearable baby carriers. Furthermore, the inventive baby carrier may advantageously combine the features of a backpack or front back carrier with the features of a cloth sling-type carrier.

According to an embodiment of the present invention, a wrap that can be used to carry young humans may be constructed by securing two pieces of fabric to a fastening device. Each piece of fabric may be attached to the fastening device by wrapping the fabric around a portion of the fastening device and securing the fabric to itself.

According to an embodiment of the fastening device, an inner aperture may be disposed within the fastening device. This inner aperture may be surrounded by two concentric circles of secondary apertures spaced evenly about the inner aperture. In embodiments of the inventive wrap in which two pieces of fabric are utilized, the fastening device may have 10 secondary apertures. One piece of fabric may be in contact with 6 secondary apertures while the other piece of fabric may be in contact with 4 secondary apertures. In embodiments of the inventive wrap in which one piece of fabric is utilized, the fastening device may have 8 secondary apertures. The single piece of fabric may be in contact with all 8 secondary apertures.

In embodiments of the inventive wrap utilizing two pieces of fabric, the first fabric may be secured to the portion of the fastening device disposed between a secondary aperture and the inner aperture. The second fabric may be secured to the portion of the fastening device that is disposed between a different secondary aperture and the inner aperture.

The first fabric may be secured to the fastening device utilizing the apertures in the fastening device in such a way as to create two loops and a tail. The first fabric may pass through two secondary apertures at each of three attachment areas in order to create the loop and tail configuration. The sizes of the loops may be adjusted by adjusting the length of the tail.

The second fabric may be secured to the fastening device utilizing the apertures in the fastening device in such a way as to create one loop and a tail. The first fabric may pass through two secondary apertures at each of two attachment areas in order to create the loop and tail configuration. The size of the loop may be adjusted by adjusting the length of the tail.

In embodiments of the inventive wrap utilizing one piece of fabric, the fabric may be secured to the portion of the fastening device disposed between a secondary aperture and the inner aperture. The fabric may be secured to the fastening device utilizing the apertures in the fastening device in such a way as to create three loops and a tail. The first fabric may pass through two secondary apertures at each of four attachment areas in order to create the loop and tail configuration. The sizes of the loops may be adjusted by adjusting the length of the tail.

In one embodiment of the fastening device, the fastening device may be constructed from three nested rings and connectors encircling all three rings. In embodiments of the inventive wrap utilizing two pieces of fabric, the fastening device may be constructed from five connectors. In embodiments of the inventive wrap utilizing one piece of fabric, the fastening device may be constructed from four connectors.

In some embodiments of the inventive concept, the fastening device may be constructed from a unitary component.

The inventive concept may include an inventive method for carrying a human. The inventive method utilizes the inventive device. The fabric may be connected to the fastening device as describe herein to create a first loop, a second loop, a third loop, and at least one tail. One loop may be positioned over the wearer's shoulder and extending across the wearer's chest to the opposite hip. A second loop may be positioned over the wearer's opposite shoulder and extend across the wearer's chest to the opposite hip. In a configuration in which two separate pieces of fabric are utilized, this second and first loop may be constructed from the same fabric. The fastening device may be positioned on the wearer's back. The third loop may be positioned around and encircling the wearer's torso. The loops may be adjusted in size by pulling on the tails. In embodiments in which two pieces of fabric are utilized, the first tail will adjust the size of the loops encircling the wearer's shoulders while the second tail will adjust the size of the loop encircling the wearer's midsection.

The inventive device may be utilized to transport a young or light-weight human by placing the young human between one or more loops and the wearer's torso. In one embodiment, the young human may be positioned to face toward the wearer's torso. By way of example, but not as a limitation, one of the young human's legs may be placed between the first loop and the human's torso. The other leg may be placed between the second loop and the human's torso. The first tail may be tightened to securely support the human and the fabric may be wrapped around the human to create a secure support. The third loop may then be placed below the human's rear end and covering the human's back. The second tail may be adjusted to securely support the human. Excess fabric may be wrapped around the wearer and secured.

DETAILED DESCRIPTION OF THE PREFERRED EMBODIMENT

The present invention will now be described more fully hereinafter with reference to the accompanying drawings, in which possible embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Figure 1:
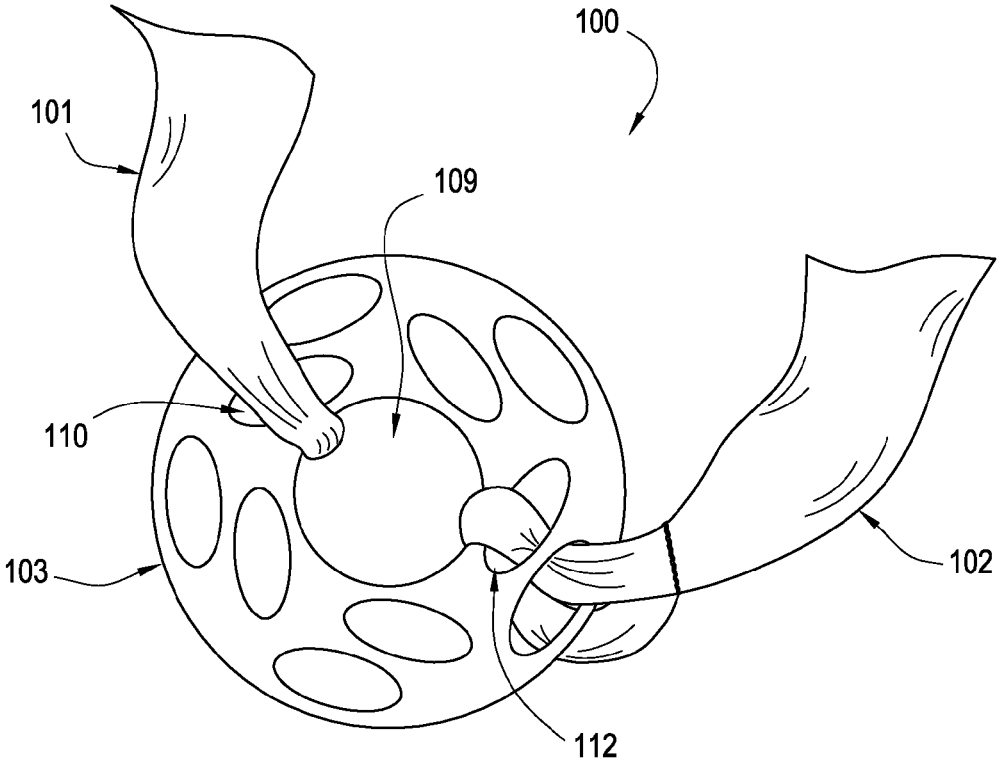
FIG. 1 is a diagram illustrating one embodiment of the wrap.

Referring to FIG. 1, a wrap that can be used to carry young humans is shown. A first fabric 101 is attached to a fastening device 103. And a second fabric 102 is also attached to the fastening device 103. The first fabric 101 and the second fabric 102 may be attached to the fastening device 103 in any way known in the art. Attachment means may include, but are not limited to, hook and loop fasteners, snaps, buttons, zippers, grommets, crimps, adhesives, or the like. This first fabric 101 or the second fabric 102 may be attached to the fastening device 103 by wrapping the fabric 101, 102 around at least a portion of the fastening device 103 and securing the fabric 101, 102 to itself.

The fabrics 101, 102 may be any of a number of shapes including, but not limited to, trapezoidal, triangular, rectangular, circular, elliptical, square, or the like. In one embodiment, the fabrics 101, 102 may be rectangular. The fabrics may be any of a number of materials including, but not limited to knit fabric, woven fabric, or the like.

Figure 2:
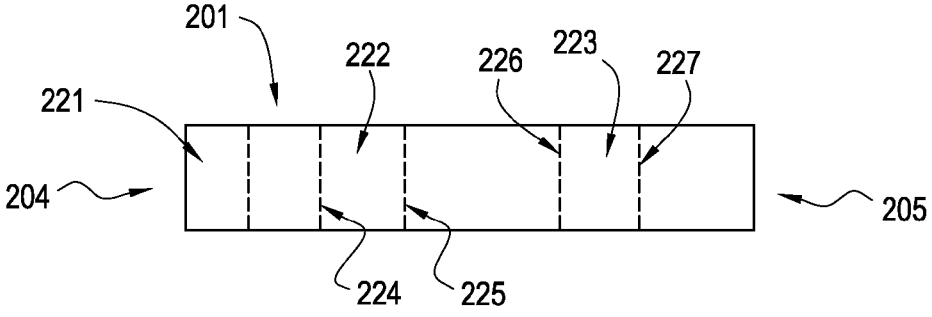
FIG. 2 is a diagram illustrating one embodiment of the first fabric.

FIG. 2 depicts an embodiment in which the first fabric 201 is rectangular. In such an embodiment, opposing sides of the first fabric 201 may comprise a first end 204 and a second end 205. Furthermore, the first fabric 201 may comprise at least three attachment areas. These attachment areas are the portion of the first fabric 201 that may be connected to the fastening device. FIG. 2 depicts a first attachment area 221 disposed on the first fabric 201 adjacent to and encompassing the first end 204. The second attachment area 222 may be located approximately one third of the length of the first fabric 201 from the first end 204. The second attachment area may further comprise an inner second attachment end 224 and an outer second attachment end 225. The inner second attachment end 224 may be located at the side of the second attachment area 222 closer to the first end 204 than the second end 205. The outer second attachment end 225 may be located at the side of the second attachment area 222 closer to the second end 205 than the first end 204.

The third attachment area 223 may be located approximately two-thirds of the length of the first fabric 201 from the first end 204. The third attachment area 223 may further comprise an inner third attachment end 226 and an outer third attachment end 227. The inner third attachment end 226 may be located at the side of the third attachment area 223 closer to the first end 204 than the second end 205. The outer third attachment end 227 may be located at the side of the third attachment area 223 closer to the second end 205 than the first end 204.

In some embodiments, the attachment areas may be disposed at different areas of the first fabric 201. In some embodiments, there may be fewer or more attachment areas. The embodiment depicted in FIG. 2 is provided for clarification and reference only and is not limiting.

The distance between the first end 204 and the second end 205 may form the length of the first fabric 201 and may be equal to or greater than 1 yard and may be equal to or less than 10 yards. The width of the first fabric 201 may be equal to the length of the first end 204. The width of the first fabric 201 may be greater than or equal to 5 inches and less than or equal to 50 inches.

Figure 3:
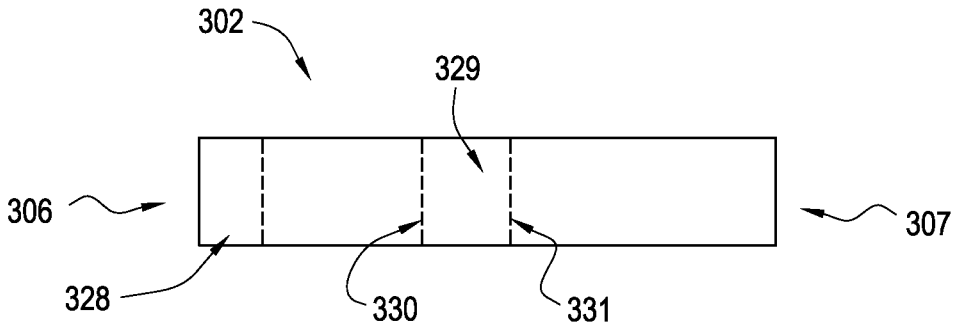
FIG. 3 is a diagram illustrating one embodiment of the second fabric.

FIG. 3 depicts an embodiment in which the second fabric 302 is rectangular. In such an embodiment, opposing sides of the second fabric 302 may comprise a third end 306 and a fourth end 307. Furthermore, the second fabric 302 may comprise at least two attachment areas. These attachment areas may be the portion of the second fabric 302 that may be connected to the fastening device.

FIG. 3 depicts a fourth attachment area 328 disposed on the second fabric 302 adjacent to and encompassing the third end 306. The fifth attachment area 329 may be located approximately one-half of the length of the second fabric 302 from the third end 306. The fifth attachment area 329 may further comprise an inner fifth attachment end 330 and an outer fifth attachment end 331. The inner fifth attachment end 330 may be located at the side of the fifth attachment area 329 closer to the third end 306 than the fourth end 307. The outer fifth attachment end 331 may be located at the side of the fifth attachment area 329 closer to the fourth end 307 than the third end 306.

In some embodiments, the attachment areas may be disposed at different areas of the first fabric 201 and second fabric 302. In some embodiments, there may be fewer or more attachment areas. The embodiments depicted in FIGS. 2 and 3 are provided for clarification and reference only and are not limiting.

The distance between the third end 306 and the fourth end 307 may form the length of the second fabric 302 and may be equal to or greater than 0.5 yards and may be equal to or less than 10 yards. The width of the second fabric 302 may be equal to the length of the third end 306. The width of the second fabric 302 may be greater than or equal to 5 inches and less than or equal to 50 inches.

Figure 4:
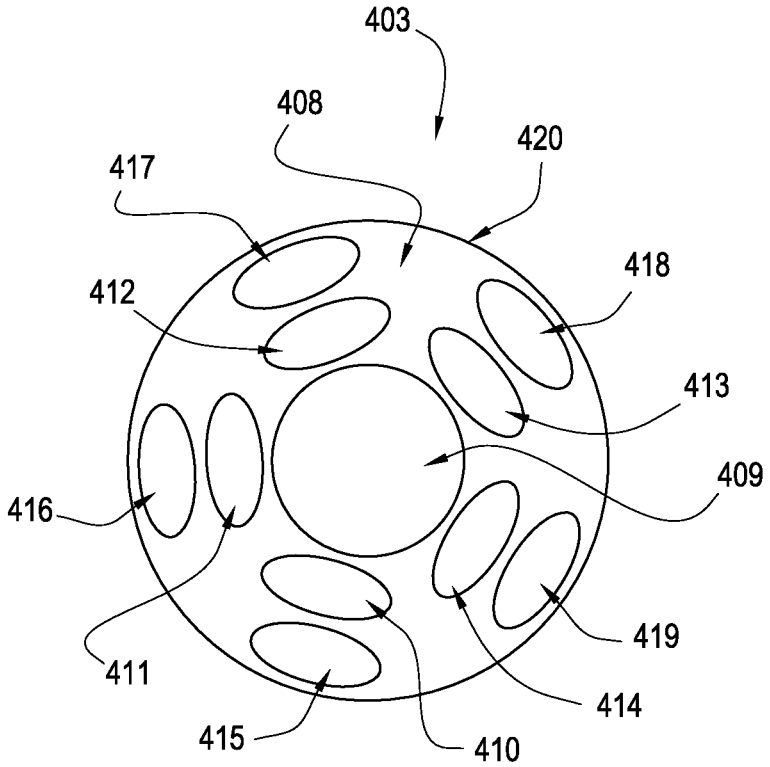
FIG. 4 is a diagram illustrating one embodiment of the fastening device.

FIG. 4 depicts one possible embodiment of the fastening device 403. The fastening device 403 may comprise a topside 408 which is opposed to the bottomside. The outer edge 420 of the fastening device 403 may be the outermost perimeter of the fastening device 403. An inner aperture 409 may be disposed within the fastening device. The inner aperture 409 may be any shape, including, but not limited to, trapezoidal, triangular, rectangular, circular, elliptical, square, or the like. Additionally, the inner aperture 409 may be a non-geometric shape. In some embodiments, the inner aperture 409 may be centered within the fastening device 403. In some embodiments, the inner aperture 409 may be offset from the center of the fastening device 403.

The topside 408 may comprise a color that is different from the color of the bottomside. In some embodiments, the fastening device 403 topside 408 may comprise a plurality of colors. In some embodiments, the plurality of colors on the topside 408 may differ from the color of the bottomside at the corresponding location. The topside 408 may have different colors in different areas to aid in the use of the wrap.

The fastening device 403 may have a plurality of apertures, in addition to the inner aperture 409, disposed throughout its surface. These apertures may be configured uniformly about the inner aperture 409 or may be dispersed an uneven intervals. In some embodiments of the present invention, the secondary apertures may be dispersed in two concentric circles about the inner aperture 409. In other embodiments of the present invention, the secondary apertures may be dispersed at uneven intervals from the inner aperture 409.

The embodiment depicted in FIG. 4 shows two concentric circles of secondary apertures dispersed about the inner aperture 409, while the embodiment of the fastening device 103 depicted in FIG. 1 shows an uneven dispersion of the secondary apertures about the inner aperture 109. In either embodiment the secondary apertures may be numbered in a clockwise or counter-clockwise rotation about the center of the fastening device 403, 103.

Turning again to FIG. 4, the secondary apertures may be designated a first middle aperture 410, a second middle aperture 411, a third middle aperture 412, a fourth middle aperture 413, a fifth middle aperture 414, a first outer aperture 415, a second outer aperture 416, a third outer aperture 417, a fourth outer aperture 418, and a fifth outer aperture 419. In the embodiment depicted in FIG. 4, the middle apertures 410, 411, 412, 413, & 414 are located closer to the inner aperture 409 than the outer edge 420. In other embodiments, the middle apertures 410, 411, 412, 413, & 414 may be located closer to the outer edge 410 than the inner aperture 409. Additionally, the outer apertures 415, 416, 417, 418, & 419 may be located closer to either the inner aperture 409 or the outer edge 420. In one embodiment, at least a portion of the middle aperture may be located at a point between the inner aperture 409 and some portion of the outer aperture of the corresponding ordinal designation.

Turning again to FIG. 1, the first fabric 101 is secured to the portion of the fastening device 103 disposed between the first middle aperture 110 and the inner aperture 109 while the second fabric 102 is secured to the portion of the fastening device 103 that is disposed between the third middle aperture 112 and the inner aperture 109. In the embodiment depicted in FIG. 1, the first fabric 101 and the second fabric 102 are secured to the fastening device 103 by extending through the first middle aperture 110 and the third middle aperture 112 and fastening back on themselves. In embodiments in which the first fabric 101 or the second fabric 102 is secured to the fastening device 103 by other means, the first middle aperture 110 or the third middle aperture 112 may be unnecessary.

Figure 5:
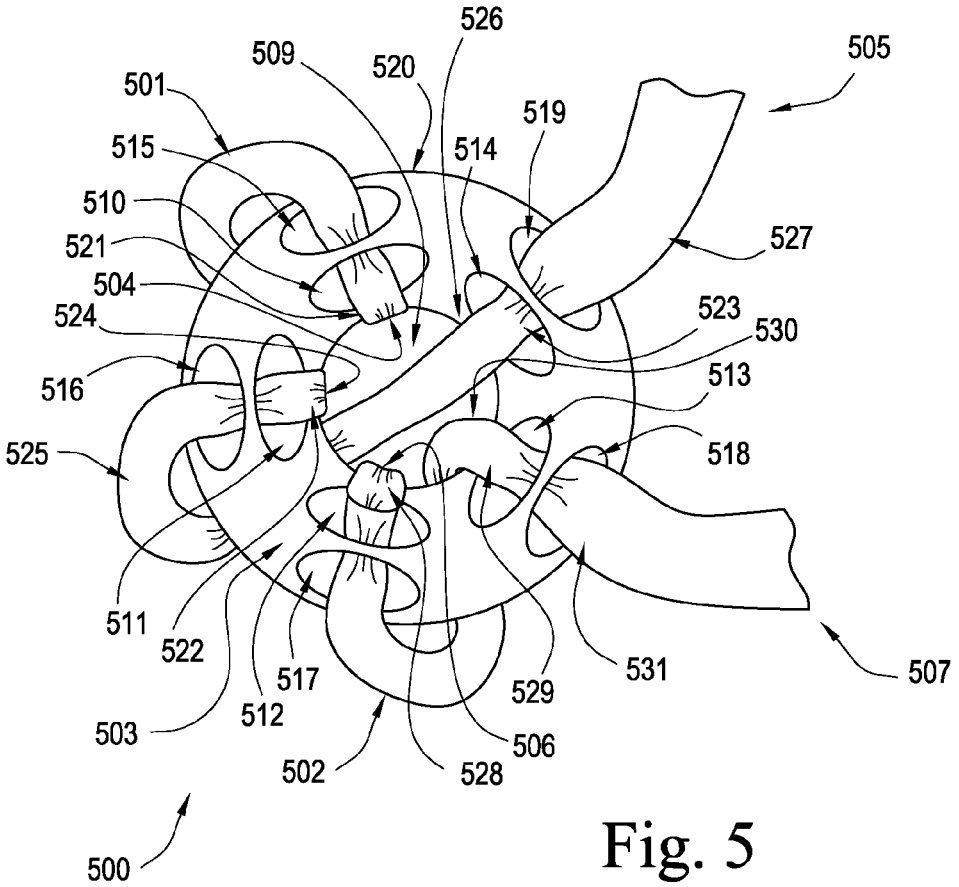
FIG. 5 is a diagram illustrating one embodiment of the wrap.

FIG. 5 depicts one possible embodiment of the wrap 500. In this embodiment, the first fabric 501 is attached to the fastening device 503 by wrapping the first attachment area 521 around the portion of the fastening device 503 disposed between the inner aperture 509 and the first middle aperture 510 and securing the first fabric 501 to itself at the first end 504. The first attachment area 521 is located under the portion of the fastening device 503 disposed between the first middle aperture 510 and the first outer aperture 515. The first attachment area 521 passes through the first outer aperture 515. The portion of the fastening device 503 located between the first outer aperture 515 and the outer edge 520 is beneath the first attachment area 521.

The inner second attachment end 524 passes through the inner aperture 509. The second attachment area 522 passes over the portion of the fastening device 503 disposed between the second middle aperture 511 and the inner aperture 509. The second attachment area 522 is located under the portion of the fastening device 503 disposed between the second middle aperture 511 and the second outer aperture 516. The outer second attachment end 525 passes through the second outer aperture 516. The portion of the fastening device 503 located between the second outer aperture 516 and the outer edge 520 is beneath the second attachment area 522.

The inner third attachment end 526 passes through the inner aperture 509. The third attachment area 523 passes over the portion of the fastening device 503 disposed between the fifth middle aperture 514 and the inner aperture 509. The third attachment area 523 is located under the portion of the fastening device 503 disposed between the fifth middle aperture 514 and the fifth outer aperture 519. The outer third attachment end 527 passes through the fifth outer aperture 519. The portion of the fastening device 503 located between the fifth outer aperture 519 and the outer edge 520 is beneath the third attachment area 523.

Continuing with FIG. 5, the second fabric 502 is attached to the fastening device 503 by wrapping the fourth attachment area 528 around the portion of the fastening device 503 disposed between the inner aperture 509 and the third middle aperture 512 and securing the second fabric 502 to itself at the third end 506. The fourth attachment area 528 is located under the portion of the fastening device 503 disposed between the third middle aperture 512 and the third outer aperture 517. The fourth attachment area 528 passes through the third outer aperture 517. The portion of the fastening device 503 located between the third outer aperture 517 and the outer edge 520 is beneath the fourth attachment area 528.

The inner fifth attachment end 530 passes through the inner aperture 509. The fifth attachment area 529 passes over the portion of the fastening device 503 disposed between the fourth middle aperture 513 and the inner aperture 509. The fifth attachment area 529 is located under the portion of the fastening device 503 disposed between the fourth middle aperture 513 and the fourth outer aperture 518. The outer fifth attachment end 531 passes through the fourth outer aperture 518. The portion of the fastening device 503 located between the fourth outer aperture 518 and the outer edge 520 is beneath the fifth attachment area 522.

The second end 505 forms a first tail and the fourth end 507 forms a second tail.

Figure 6:
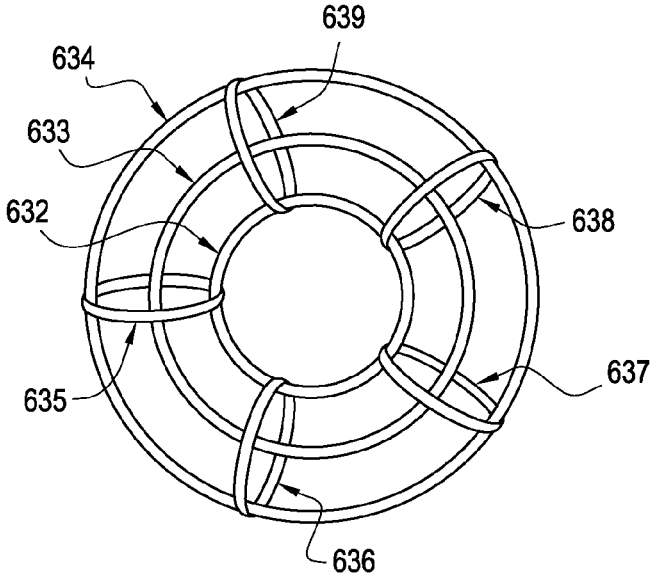
FIG. 6 is a diagram illustrating on embodiment of the fastening device.

FIG. 6 depicts one possible embodiment of the fastening device 603. The embodiment depicted in FIG. 6 is comprised of an inner ring 632, a middle ring 633, and an outer ring 634. The rings 632, 633, or 634 may be rigid or flexible. In some embodiments, the rings 632, 633, and 634 may be round, in other embodiments they may be, by way of example and not as a limitation, rectangular, elliptical, non-geometric or the like. The rings 632, 633, and 634 may be metal, plastic, fabric, wood, or the like. The inner ring 632 may be nested within the aperture of the middle ring 633. The middle ring 633 may be nested within the aperture of the outer ring 634.

The rings 632, 633, and 634 may be held together by a plurality of connectors. In the embodiment depicted in FIG. 6, there is a first connector 635, a second connector 636, a third connector 637, a fourth connector 638, and a fifth connector 638. The connectors may be flexible of rigid. In one embodiment the connectors 635, 636, 637, 638, and 639 may be constructed from fabric. In other embodiments, the connectors may be rubber, plastic, metal, or the like. The connectors 635, 636, 637, 638, and 639 may fasten the rings 634, 633, and 632 to one another. In embodiments of the wrap utilizing a fastening device as depicted in FIG. 6, the inner aperture may be the aperture in the inner ring 632. The middle apertures may be the apertures bounded by the inner ring 632, the middle ring 633, and each connector 635, 636, 637, 638, and 639. The outer apertures may be the apertures bounded by the middle ring 633, the outer ring 634, and each of the connectors 635, 636, 637, 638, and 639.

In some embodiments of the inventive concept, the fastening device may be constructed from a unitary component. A unitary component may comprise a single piece of plastic, wood, metal, paper, fabric, or the like. In such embodiments, the fastening device may be machined, molded, or the like. While the fastening device depicting in FIG. 6 comprises five connectors, those skilled in the art will appreciate that a fastening device may comprise any number of connectors. In one embodiment of the inventive device, the fastening device may comprise four connectors.

Figure 7:
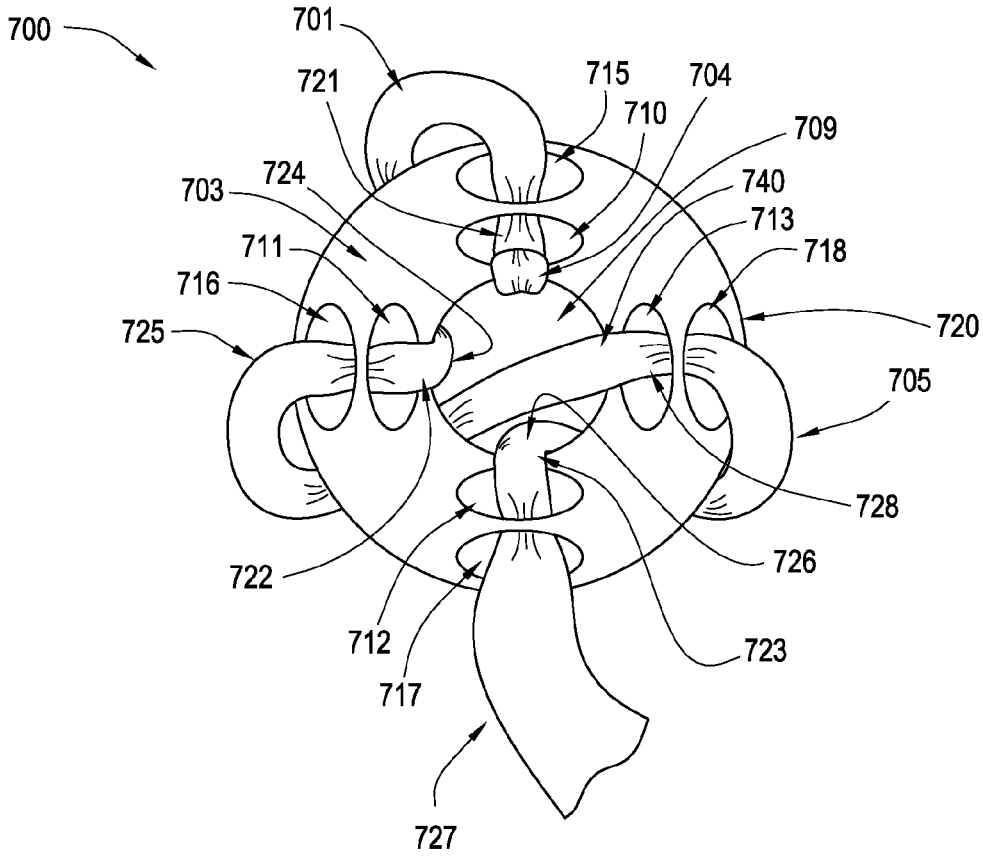
FIG. 7 is a diagram illustrating one embodiment of the wrap.

FIG. 7 depicts an embodiment of the wrap 700 in which there is no second fabric. In this embodiment, the fastening device 703 has a total of 9 apertures. In such an embodiment, the first fabric 701 may comprise at least four attachment areas. These attachment areas may be the portion of the first fabric 701 that may be connected to the fastening device 703. A first attachment area 721 may be disposed on the first fabric 701 adjacent to and encompassing the first end 704. The second attachment area 722 may be located approximately one-quarter of the length of the first fabric 701 from the first end 704. The second attachment area 722 may further comprise an inner second attachment end 724 and an outer second attachment end 725. The inner second attachment end 724 may be located at the side of the second attachment area 722 closer to the first end 704 than the second end 705. The outer second attachment end 725 may be located at the side of the second attachment area 722 closer to the second end 705 than the first end 704.

The third attachment area 723 may be located approximately one-half of the length of the first fabric 701 from the first end 704. The third attachment area 723 may further comprise an inner third attachment end 726 and an outer third attachment end 727. The inner third attachment end 726 may be located at the side of the third attachment area 723 closer to the first end 704 than the second end 705. The outer third attachment end 727 may be located at the side of the third attachment area 723 closer to the second end 705 than the first end 704.

The fourth attachment area 728 may be located approximately three-quarters of the length of the first fabric 701 from the first end 704. The fourth attachment area 728 may further comprise an inner fourth attachment end 740 and an outer fourth attachment end 741. The inner fourth attachment end 740 may be located at the side of the fourth attachment area 728 closer to the first end 704 than the second end 705. The outer fourth attachment end 741 may be located at the side of the fourth attachment area 728 closer to the second end 705 than the first end 704.

In the embodiment depicted in FIG. 7, the first fabric 701 is attached to the fastening device 703 by wrapping the first attachment area 721 around the portion of the fastening device 703 disposed between the inner aperture 709 and the first middle aperture 710 and securing the first fabric 701 to itself at the first end 704. The first attachment area 721 is located under the portion of the fastening device 703 disposed between the first middle aperture 710 and the first outer aperture 715. The first attachment area 721 passes through the first outer aperture 715. The portion of the fastening device 703 located between the first outer aperture 715 and the outer edge 720 is beneath the first attachment area 721.

The inner second attachment end 724 passes through the inner aperture 709. The second attachment area 722 passes over the portion of the fastening device 703 disposed between the second middle aperture 711 and the inner aperture 709. The second attachment area 722 is located under the portion of the fastening device 703 disposed between the second middle aperture 711 and the second outer aperture 716. The outer second attachment end 725 passes through the second outer aperture 716. The portion of the fastening device 703 located between the second outer aperture 716 and the outer edge 720 is beneath the second attachment area 722.

The inner third attachment end 726 passes through the inner aperture 709. The third attachment area 723 passes over the portion of the fastening device 703 disposed between the third middle aperture 712 and the inner aperture 709. The third attachment area 723 is located under the portion of the fastening device 703 disposed between the third middle aperture 712 and the third outer aperture 717. The outer third attachment end 727 passes through the third outer aperture 717. The portion of the fastening device 703 located between the third outer aperture 717 and the outer edge 720 is beneath the third attachment area 723.

The inner fourth attachment end 740 passes through the inner aperture 709. The fourth attachment area 728 passes over the portion of the fastening device 703 disposed between the fourth middle aperture 713 and the inner aperture 709. The fourth attachment area 728 is located under the portion of the fastening device 703 disposed between the fourth middle aperture 413 and the fourth outer aperture 718. The outer fourth attachment end 741 passes through the fourth outer aperture 718. The portion of the fastening device 703 located between the fourth outer aperture 718 and the outer edge 720 is beneath the fourth attachment area 728.

The second end 705 forms a first tail.

The inventive concept may include an inventive method for carrying a human. The inventive method utilizes the inventive device. The fabric may be connected to the fastening device as describe herein to create a first loop, a second loop, a third loop, and at least one tail. One loop may be positioned over the wearer's shoulder and extending across the wearer's chest to the opposite hip. A second loop may be positioned over the wearer's opposite shoulder and extend across the wearer's chest to the opposite hip. In a configuration in which two separate pieces of fabric are utilized, this second and first loop may be constructed from the same fabric. The fastening device may be positioned on the wearer's back. The third loop may be positioned around and encircling the wearer's torso. The loops may be adjusted in size by pulling on the tails. In embodiments in which two pieces of fabric are utilized, the first tail will adjust the size of the loops encircling the wearer's shoulders while the second tail will adjust the size of the loop encircling the wearer's midsection.

The inventive device may be utilized to transport a young or light-weight human by placing the young human between one or more loops and the wearer's torso. In one embodiment, the young human may be positioned to face toward the wearer's torso. By way of example, but not as a limitation, one of the young human's legs may be placed between the first loop and the human's torso. The other leg may be placed between the second loop and the human's torso. The first tail may be tightened to securely support the human and the fabric may be wrapped around the human to create a secure support. The third loop may then be placed below the human's rear end and covering the human's back. The second tail may be adjusted to securely support the human. Excess fabric may be wrapped around the wearer and secured.

The foregoing examples have been provided in the interest of clarity to illustrate an embodiment of the present invention in substantial detail.

A person of skill in the art will appreciate that one or more of the above provided embodiments may be included in the wearing of the wrap of the present invention. Additionally, a person of skill in the art will appreciate additional embodiments that would be included within the scope and spirit of the present invention, after having the benefit of this disclosure. Furthermore, a skilled artisan will appreciate that the operations described above, along with additional operations that would be apparent to those in the art, may be performed exclusively, incrementally, sequentially, simultaneously, or any other operative configuration.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

What is claimed is:

1. A wrap for carrying a young human comprising:

a first fabric having a rectangular shape wherein a first end of the first fabric comprises a first short side of the rectangular shape of the first fabric and a second end of the first fabric comprises a second short side of the rectangular shape of the first fabric, wherein the first end and the second end geometrically oppose one another;

a second fabric having a rectangular shape wherein a third end of the second fabric comprises a third short side of the rectangular shape of the second fabric and a fourth end of the second fabric comprises a fourth short side of the rectangular shape of the second fabric wherein the third end and the fourth end geometrically oppose one another; and a fastening device further comprising:

a topside;

a bottomside;

an outer edge;

an inner aperture;

a first middle aperture;

a second middle aperture;

a third middle aperture;

a fourth middle aperture;

a fifth middle aperture;

a first outer aperture;

a second outer aperture;

a third outer aperture;

a fourth outer aperture; and a fifth outer aperture;

wherein the outer edge is disposed along the perimeter of the fastening device furthest away from the inner aperture;

wherein the middle apertures are dispersed about the inner aperture;

wherein the outer apertures are dispersed about the inner aperture;

wherein at least a portion of the first middle aperture is located at a point between the perimeter of the outer first aperture and the perimeter of the inner aperture;

wherein at least a portion of the second middle aperture is located at a point between the perimeter of the outer second aperture and the perimeter of the inner aperture;

wherein at least a portion of the third middle aperture is located at a point between the perimeter of the outer third aperture and the perimeter of the inner aperture;

wherein at least a portion of the fourth middle aperture is located at a point between the perimeter of the outer fourth aperture and the perimeter of the inner aperture;

wherein at least a portion of the fifth middle aperture is located at a point between the perimeter of the outer fifth aperture and the perimeter of the inner aperture;

wherein the first end is secured to the portion of the fastening device disposed between the inner aperture and the first middle aperture; and wherein the third end is secured to the portion of the fastening device disposed between the inner aperture and the third middle aperture.

2. The wrap according to claim 1 wherein the first fabric further comprises:

a first attachment area;

a second attachment area; and a third attachment area;

wherein the first attachment area is disposed approximately adjacent to the first end;

wherein the second attachment area is disposed approximately one third the length of the first fabric away from the first end;

wherein the second attachment area further comprises:

an inner second attachment end; and an outer second attachment end;

wherein the inner second attachment end is located closer to the first end than the second end;

wherein the outer second attachment end is located closer to the second end than the first end;

wherein the third attachment area is disposed approximately two thirds the length of the first fabric away from the first end;

wherein the second attachment area further comprises:

an inner third attachment end; and an outer third attachment end;

wherein the inner third attachment end is located closer to the first end than the second end;

wherein the outer third attachment end is located closer to the second end than the first end;

wherein the portion of the fastening device disposed between the first middle aperture and the first outer aperture is above the first attachment area;

wherein the portion of the fastening device disposed between the first outer aperture and the outer edge of the fastening device is below the first attachment area;

wherein the inner second attachment end passes through the inner aperture;

wherein the portion of the fastening device disposed between the second middle aperture and the second outer aperture is disposed above the second attachment area;

wherein the portion of the fastening device disposed between the inner aperture and the second middle aperture is disposed below the second attachment area;

wherein the portion of the fastening device disposed between the second outer aperture and the outer edge of the fastening device is disposed below the second attachment area;

wherein the inner third attachment end passes through the inner aperture;

wherein the portion of the fastening device disposed between the fifth middle aperture and the fifth outer aperture is disposed above the third attachment area;

wherein the portion of the fastening device disposed between the inner aperture and the fifth middle aperture is disposed below the third attachment area;

wherein the portion of the fastening device disposed between the fifth outer aperture and the outer edge of the fastening device is disposed below the third attachment area;

wherein the second fabric further comprises:

a fourth attachment area; and a fifth attachment area;

wherein the fourth attachment area is disposed approximately adjacent to the third end;

wherein the fifth attachment area is disposed approximately one half the length of the second fabric away from the third end;

wherein the fifth attachment area further comprises:

an inner fifth attachment end; and an outer fifth attachment end;

wherein the inner fifth attachment end is located closer to the third end than the fourth end;

wherein the outer fifth attachment end is located closer to the fourth end than the third end;

wherein the portion of the fastening device disposed between the third middle aperture and the third outer aperture is disposed above the fourth attachment area;

wherein the portion of the fastening device disposed between the third outer aperture and the outer edge of the fastening device is disposed below the fourth attachment area;

wherein the inner fifth attachment end passes through the inner aperture;

wherein the portion of the fastening device disposed between the fourth middle aperture and the fourth outer aperture is disposed above the fifth attachment area;

wherein the portion of the fastening device disposed between the fourth middle aperture and the inner aperture is disposed below the fifth attachment area; and wherein the portion of the fastening device disposed between the fourth outer aperture and the outer edge of the fastening device is disposed below the fifth attachment area.

3. The wrap according to claim 1 wherein the fastening device further comprises:

an inner ring;

a middle ring;

an outer ring;

a first connector;

a second connector;

a third connector;

a fourth connector; and a fifth connector;

wherein the inner ring is nested inside the middle ring;

wherein the middle ring is nested inside the outer ring;

wherein the first connector encircles a first point of the inner ring, a first point of the middle ring, and a first point of the outer ring;

wherein the second connector encircles a second point of the inner ring, a second point of the middle ring, and a second point of the outer ring, wherein the third connector encircles a third point of the inner ring, a third point of the middle ring, and a third point of the outer ring;

wherein the fourth connector encircles a fourth point of the inner ring, a fourth point of the middle ring, and a fourth point of the outer ring, wherein the fifth connector encircles a fifth point of the inner ring, a fifth point of the middle ring, and a fifth point of the outer ring;

wherein the first connector, the second connector, the third connector, the fourth connector, and the fifth connector are consecutively disposed about the inner ring, the middle ring, and the outer ring;

wherein the aperture bounded by portions of the inner ring, the middle ring, the first connector, and the second connecter comprise the first middle aperture;

wherein the aperture bounded by portions of the middle ring, the outer ring, the first connector, and the second connecter comprise the first outer aperture;

wherein the aperture bounded by portions of the inner ring, the middle ring, the second connector, and the third connecter comprise the second middle aperture;

wherein the aperture bounded by portions of the middle ring, the outer ring, the second connector, and the third connecter comprise the second outer aperture;

wherein the aperture bounded by portions of the inner ring, the middle ring, the third connector, and the fourth connecter comprise the third middle aperture;

wherein the aperture bounded by portions of the middle ring, the outer ring, the third connector, and the fourth connecter comprise the third outer aperture;

wherein the aperture bounded by portions of the inner ring, the middle ring, the fourth connector, and the fifth connecter comprise the fourth middle aperture;

wherein the aperture bounded by portions of the middle ring, the outer ring, the fourth connector, and the fifth connecter comprise the fourth outer aperture;

wherein the aperture bounded by portions of the inner ring, the middle ring, the first connector, and the fifth connecter comprise the fifth middle aperture; and wherein the aperture bounded by portions of the middle ring, the outer ring, the first connector, and the fifth connecter comprise the fifth outer aperture.

4. The wrap according to claim 1 wherein the fastening device comprises a unitary component.

5. The wrap according to claim 1 wherein the distance between the first end and the second end is equal to or greater than 1 yards and less than or equal to 10 yards.

6. The wrap according to claim 1 wherein the length of the first end is equal to or greater than 5 inches and less than or equal to 50 inches.

7. The wrap according to claim 1 wherein the topside comprises a topside color; and the bottomside comprises a bottomside color; and wherein the bottomside color is not the same as the topside color.

8. The wrap according to claim 1 wherein the distance between the third end and the fourth end is equal to or greater than 0.5 yards and less than or equal to 10 yards.

9. The wrap according to claim 1 wherein the length of the third end is equal to or greater than 5 inches and less than or equal to 50 inches.

10. A wrap for carrying a young human comprising:

a first fabric having a rectangular shape, wherein a first end of the first fabric comprises a first short side of the rectangular shape of the first fabric and a second end of the first fabric comprises a second short side of the rectangular shape of the first fabric, wherein the first end and the second end geometrically oppose one another; and a fastening device further comprising:

a topside;

a bottomside;

an outer edge;

an inner aperture;

a first middle aperture;

a second middle aperture;

a third middle aperture;

a fourth middle aperture;

a first outer aperture;

a second outer aperture;

a third outer aperture; and a fourth outer aperture;

wherein the outer edge is disposed along the perimeter of the fastening device furthest away from the inner aperture;

wherein the middle apertures are dispersed about the inner aperture;

wherein the outer apertures are dispersed about the inner aperture;

wherein at least a portion of the first middle aperture is located at a point between the perimeter of the outer first aperture and the perimeter of the inner aperture;

wherein at least a portion of the second middle aperture is located at a point between the perimeter of the outer second aperture and the perimeter of the inner aperture;

wherein at least a portion of the third middle aperture is located at a point between the perimeter of the outer third aperture and the perimeter of the inner aperture;

wherein at least a portion of the fourth middle aperture is located at a point between the perimeter of the outer fourth aperture and the perimeter of the inner aperture; and wherein the first end is secured to the portion of the fastening device disposed between the inner aperture and the first middle aperture.

11. The wrap according to claim 10 wherein the first fabric further comprises:

a first attachment area;

a second attachment area;

a third attachment area; and a fourth attachment area wherein the first attachment area is disposed approximately adjacent to the first end;

wherein the second attachment area is disposed approximately one quarter the length of the first fabric away from the first end;

wherein the second attachment area further comprises:

an inner second attachment end; and an outer second attachment end;

wherein the inner second attachment end is located closer to the first end than the second end;

wherein the outer second attachment end is located closer to the second end than the first end;

wherein the third attachment area is disposed approximately one half the length of the first fabric away from the first end;

wherein the third attachment area further comprises:

an inner third attachment end; and an outer third attachment end;

wherein the inner third attachment end is located closer to the first end than the second end;

wherein the outer third attachment end is located closer to the second end than the first end;

wherein the fourth attachment area is disposed approximately three quarters of the length of the first fabric way from the first end;

wherein the fourth attachment area further comprises:

an inner fourth attachment end; and an outer fourth attachment end;

wherein the inner fourth attachment end is located closer to the first end than the second end;

wherein the outer fourth attachment end is located closer to the second end than the first end;

wherein the portion of the fastening device disposed between the first middle aperture and the first outer aperture is above the first attachment area;

wherein the portion of the fastening device disposed between the first outer aperture and the outer edge of the fastening device is below the first attachment area;

wherein the inner second attachment end passes through the inner aperture;

wherein the portion of the fastening device disposed between the second middle aperture and the second outer aperture is disposed above the second attachment area;

wherein the portion of the fastening device disposed between the inner aperture and the second middle aperture is disposed below the second attachment area;

wherein the portion of the fastening device disposed between the second outer aperture and the outer edge of the fastening device is disposed below the second attachment area;

wherein the inner third attachment end passes through the inner aperture;

wherein the portion of the fastening device disposed between the third middle aperture and the third outer aperture is disposed above the third attachment area;

wherein the portion of the fastening device disposed between the inner aperture and the third middle aperture is disposed below the third attachment area;

wherein the portion of the fastening device disposed between the third outer aperture and the outer edge of the fastening device is disposed below the third attachment area;

wherein the inner fourth attachment end passes through the inner aperture;

wherein the portion of the fastening device disposed between the fourth middle aperture and the fourth outer aperture is disposed above the fourth attachment area;

wherein the portion of the fastening device disposed between the fourth middle aperture and the inner aperture is disposed below the fourth attachment area; and wherein the portion of the fastening device disposed between the fourth outer aperture and the outer edge of the fastening device is disposed below the fourth attachment area.

12. The wrap according to claim 10 wherein the fastening device further comprises:

an inner ring;

a middle ring;

an outer ring;
a first connector;
a second connector;
a third connector; and
a fourth connector;
wherein the inner ring is nested inside the middle ring;
wherein the middle ring is nested inside the outer ring;
wherein the first connector encircles a first point of the inner ring, a first point of the middle ring, and a first point of the outer ring;
wherein the second connector encircles a second point of the inner ring, a second point of the middle ring, and a second point of the outer ring,
wherein the third connector encircles a third point of the inner ring, a third point of the middle ring, and a third point of the outer ring;
wherein the fourth connector encircles a fourth point of the inner ring, a fourth point of the middle ring, and a fourth point of the outer ring,
wherein the first connector, the second connector, the third connector, and the fourth connector are consecutively disposed on the inner ring, the middle ring, and the outer ring;
wherein the aperture bounded by portions of the inner ring, the middle ring, the first connector, and the second connecter comprise the first middle aperture;
wherein the aperture bounded by portions of the middle ring, the outer ring, the first connector, and the second connecter comprise the first outer aperture;
wherein the aperture bounded by portions of the inner ring, the middle ring, the second connector, and the third connecter comprise the second middle aperture;
wherein the aperture bounded by portions of the middle ring, the outer ring, the second connector, and the third connecter comprise the second outer aperture;
wherein the aperture bounded by portions of the inner ring, the middle ring, the third connector, and the fourth connecter comprise the third middle aperture;
wherein the aperture bounded by portions of the middle ring, the outer ring, the third connector, and the fourth connecter comprise the third outer aperture;
wherein the aperture bounded by portions of the inner ring, the middle ring, the fourth connector, and the fifth connecter comprise the fourth middle aperture; and
wherein the aperture bounded by portions of the middle ring, the outer ring, the fourth connector, and the fifth connecter comprise the fourth outer aperture.

13. The wrap according to claim 10 wherein the first fabric further comprises a knit fabric.

14. The wrap according to claim 1 wherein the fastening device comprises a unitary component.

15. The wrap according to claim 10 wherein the distance between the first end and the second end is equal to or greater than 1 yards and less than or equal to 10 yards.

16. The wrap according to claim 10 wherein the length of the first end is equal to or greater than 5 inches and less than or equal to 50 inches.

17. The wrap according to claim 10 wherein the topside has a topside color and the bottomside has a bottomside color wherein the bottomside color is not the same as the topside color.

* * * * *